US006554248B2

(12) United States Patent
Taniguchi et al.

(10) Patent No.: US 6,554,248 B2
(45) Date of Patent: Apr. 29, 2003

(54) APPARATUS FOR ESTIMATING VALVE-CLEARANCE OF AN ELECTRO-MAGNETICALLY OPERATED VALVE AND VALVE-OPERATION CONTROLLER FOR THE ELECTRO-MAGNETICALLY OPERATED VALVE

(75) Inventors: Ikuhiro Taniguchi, Zushi (JP); Taketoshi Kawabe, Yokohama (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 09/929,059

(22) Filed: Aug. 15, 2001

(65) Prior Publication Data

US 2002/0056821 A1 May 16, 2002

(30) Foreign Application Priority Data

Aug. 15, 2000 (JP) ..... 2000-246396

(51) Int. Cl.[7] ..... F16K 31/02

(52) U.S. Cl. ..... 251/129.04; 251/129.16; 251/129.19

(58) Field of Search ..... 251/129.04, 129.1, 251/129.16, 129.19; 137/554; 123/90.11

(56) References Cited

U.S. PATENT DOCUMENTS 5,261,610 A * 11/1993 Waryu et al. ..... 251/129.19
5,490,534 A * 2/1996 Van Rens ..... 251/129.1
5,704,314 A * 1/1998 Allmendinger et al. .. 123/90.11
5,762,035 A * 6/1998 Schebitz ..... 123/90.11
5,785,016 A * 7/1998 Enderle et al. ..... 123/90.11
5,927,237 A * 7/1999 Komatsu et al. ..... 251/129.19
5,961,097 A * 10/1999 Zimmermann ..... 123/90.11
5,964,192 A * 10/1999 Ishii ..... 123/90.11
5,967,413 A * 10/1999 Tian ..... 251/129.19
6,032,925 A * 3/2000 Izuo et al. ..... 251/129.19
6,062,531 A * 5/2000 Rapp et al. ..... 251/129.19
6,101,992 A * 8/2000 Pischinger et al. ..... 123/90.11
6,289,858 B1 * 9/2001 Altdorf et al. ..... 251/129.19

FOREIGN PATENT DOCUMENTS

DE 19511880 A1 * 12/1995 ..... 251/129.16
EP 814238 A1 * 12/1997 ..... 251/129.16
JP 10-332027 12/1998
JP 11-13435 1/1999

* cited by examiner

*Primary Examiner*—Gene Mancene
*Assistant Examiner*—John Bastianelli
(74) *Attorney, Agent, or Firm*—Foley & Lardner

(57) ABSTRACT

A valve-clearance estimating apparatus estimates a valve-clearance that is a minute spacing between a valve drive element, and a valve element, which form an essential part of a moving body of an electro-magnetically operated valve. A position sensor determining an instant position of the valve drive element, a mass-change estimating portion estimate the mass of the moving body moving together with the valve drive element, and a valve-clearance estimating portion estimates the valve-clearance on the basis of a given position of the valve drive element determined by the position sensor at a time when a change in the mass of the moving body is estimated and when the valve drive element reaches proximate to one of its extreme positions.

12 Claims, 7 Drawing Sheets

APPARATUS FOR ESTIMATING VALVE-CLEARANCE OF AN ELECTRO-MAGNETICALLY OPERATED VALVE AND VALVE-OPERATION CONTROLLER FOR THE ELECTRO-MAGNETICALLY OPERATED VALVE

BACKGROUND OF THE INVENTION

1. Field of the Invention

The present invention relates generally to an electro-magnetically operated valve whose opening and closing movement is driven by electro-magnetic force and resilient force, and more particularly, it relates to an apparatus for estimating a valve-clearance defined between a valve element and a valve drive element of the electro-magnetically operated valve suitable for being used as intake or exhaust valve of an internal combustion engine. Furthermore, the present invention relates to a valve-operation controller provided with the valve-clearance estimating apparatus and controlling the opening and closing movement of the electro-magnetically operated valve.

2. Description of the Related Art

In a valve drive system of intake and exhaust valves of an internal combustion engine, there has been proposed an electro-magnetic drive system which operates valves by using an electro-magnetic force, instead of the conventional cam-operated valve drive system. The electro-magnetically operated valves do not need any cam-operated drive mechanism for valves, and additionally facilitate the opening and closing timing of the intake and exhaust valves of an internal combustion engine, depending on the operating condition of the internal combustion engine, so that the output of the internal combustion engine may be appreciably increased accompanied by a reduction in the engine fuel consumption.

The electro-magnetically operated valve ordinarily includes a valve drive element made of soft magnetic material, a pair of electro-magnets capable of attracting the valve drive element by electro-magnetic force, and a resilient member or a spring for urging the valve drive element toward its neutral position located between the pair of electro-magnets. The pair of electro-magnets alternatively attract the valve drive element while causing the alternative opening and closing movement of the valve element arranged to move in association with the valve drive element. In this type of electro-magnetically operated valve, when the valve element is secured to the valve drive element so as to be integrally moved, the position of the valve drive element at the time when the valve element is urged to its closing position changes due to thermal extension of a valve stem and abrasion of the valve element and its associated valve seat caused by repeated contacting of the valve element and the valve seat. Thus, such a deficiency of the conventional electro-magnetically operated valve is that the valve element is unable come to the closing position accurately by seating on the associated valve seat.

To overcome this deficiency, there has been proposed a device for moving an electro-magnetically operated valve to its closing position, in which the valve drive element and the valve element of the electro-magnetically operated valve are formed as cooperative separate moving members and a small clearance, which will be herein referred to as a valve-clearance, is provided between the valve drive element moved to its one extreme position for closing the valve element and the valve element located at the completely closing position of the electro-magnetically operated valve.

In order to control the electro-magnetically operated valve to ensure the closing of the valve and reducing the moving speed of the valve at the moment of being seated on the valve seat and thereby sufficiently reducing noise generation at the moment of seating of the valve on the valve seat, it is necessary not only to accurately detect or determine a change in the position of the valve element during the movement thereof but also to determine a certain moment at which the valve is seated on the valve seat. However, it is known that the determination of the position change of the valve element by the use of any position sensor is technically difficult to realize from the viewpoint of a limitation to the mounting of the position sensor on or about the valve element as well as a difficulty in isolating heat, which might transmit from an engine to the position sensor.

On the other hand, although it is possible to arrange a position sensor around the valve drive element in order to detect a change in the position during its movement, detection of position of the valve drive element cannot be effective for accurately detecting or determining the positional change in the moving valve element for the reason that any change in the valve-clearance between the valve element and the valve drive element will result in failure of the position sensor to adequately function. Consequently, the speed of the valve at the moment when it is seated on the valve seat is large enough for generating a large noise. Furthermore, it cannot be ensured that the valve is constantly moved to an accurate position for closing thereof.

SUMMARY OF THE INVENTION

Therefore, an object of the present invention is to overcome various problems encountered by the above-described known electro-magnetically operated valve, which is not exclusively, but preferably, used as intake and exhaust valves for internal combustion engines.

Another object of the present invention is to provide a novel apparatus for estimating a valve-clearance of an electro-magnetically operated valve defined as the spacing between a valve element and a valve drive element of the valve in order to achieve an accurate determining of a change in the valve position during the movement of the valve without assistance of any position sensor.

A further object of the present invention is to provide a controller for the operation of an electro-magnetically valve, which is able to achieve an optimum control of the valve by the use of dynamically estimated valve-clearance.

In accordance with one aspect of the present invention, there is provided a valve-clearance estimating apparatus for estimating a valve-clearance that is a minute spacing produced between a valve drive element and a valve element, which form part of a moving body of an electro-magnetically operated valve additionally provided with a pair of electromagnets arranged to be spaced apart from one another via the valve drive element and generating, upon being electrically excited, an electro-magnetic force acting on the valve drive element, and a pair of springs exhibiting a spring force also acting on the valve drive element, the electro-magnetic force and the spring force permitting the valve drive element to move thereby driving a movement of the valve element toward either one of valve-closing and valve-opening positions, wherein the valve-clearance estimating apparatus is operatively connected to a position sensor arranged to determine an instant position of the valve drive element of the electro-magnetically operated valve during a movement of the valve drive element, and includes: a mass-change estimating portion that estimates a change in a mass of the moving body moving together with the valve drive element; and a valve-clearance estimating portion that estimates the valve-clearance on the basis of the position of the valve drive element determined by the position sensor at a time when the change in the mass of the moving body is estimated.

In accordance with a further aspect of the present invention, there is provided a control apparatus for controlling the operation of an electro-magnetically operated valve including: a valve drive element; a valve element driven by the valve drive element; a pair of electro-magnets arranged to be spaced apart from one another via the valve drive element and generating, upon being electrically excited, an electro-magnetic force acting on the valve drive element; the valve drive element and the valve element forming an essential part of a moving body of the electro-magnetically operated valve, and a pair of springs exhibiting a spring force acting on the valve drive element, the electro-magnetic force and the spring force permitting the valve drive element to move thereby causing a movement of the valve element toward either one of valve-closing and valve-opening positions of the electro-magnetically operated valve. The control apparatus includes: an apparatus for estimating a valve-clearance that is a minute spacing produced between the valve drive element and the valve element, the valve-clearance estimating apparatus comprising a position sensor for determining a position of the valve drive element during a movement of the valve drive element, a mass-change estimating portion estimating a change in a mass of the moving body moving together with the valve drive element, and a valve-clearance estimating portion estimating the valve-clearance on the basis of the position of the valve drive element grasped by the position sensor at a time when the change in the mass of the moving body is estimated; and a control-switch arranged to switch a control gain in controlling the operation of the electro-magnetically operated valve in response to a position of the valve drive element determined by the position sensor of the valve-clearance estimating apparatus and a valve-clearance estimated by the valve-clearance estimating apparatus.

In accordance with a further aspect of the present invention, there is provided a method of controlling the operation of an electro-magnetically operated valve which is provided with: a valve drive element; a valve element driven by the valve drive element; a pair of electro-magnets arranged to be spaced apart from one another via the valve drive element and generating, upon being electrically excited, an electro-magnetic force acting on the valve drive element, the valve drive element and the valve element forming an essential part of a moving body of the electro-magnetically operated valve; a pair of springs exhibiting a spring force acting on the valve drive element, the electro-magnetic force and the spring force permitting the valve drive element to move thereby causing a movement of the valve element toward either one of valve-closing and valve-opening positions of the electro-magnetically operated valve; and an apparatus for estimating a valve-clearance that is a minute spacing produced between the valve drive element and the valve element, the valve-clearance estimating apparatus comprising a position sensor that determines an instant position of the valve drive element during a movement of the valve drive element, a mass-change estimating portion estimating a change in a mass of the moving body moving together with the valve drive element, and a valve-clearance estimating portion estimating the valve-clearance on the basis of the position of the valve drive element determined by the position sensor at a time when the change in the mass of the moving body is estimated, wherein the controlling method includes: switching a control gain in controlling the operation of the electro-magnetically operated valve in response to a position of the valve drive element grasped by the position sensor of the valve-clearance estimating apparatus and a valve-clearance estimated by the valve-clearance estimating apparatus.

The above and other objects, aspects, features and advantages of the present invention will become more apparent from the ensuing description of the preferred embodiments thereof, in conjunction the accompanying drawings.

BRIEF DESCRIPTION OF THE DRAWINGS

Referring now to the accompanying drawings which form a part of the present disclosure.

DETAILED DESCRIPTION OF THE PREFERRED EMBODIMENTS

Figure 1:
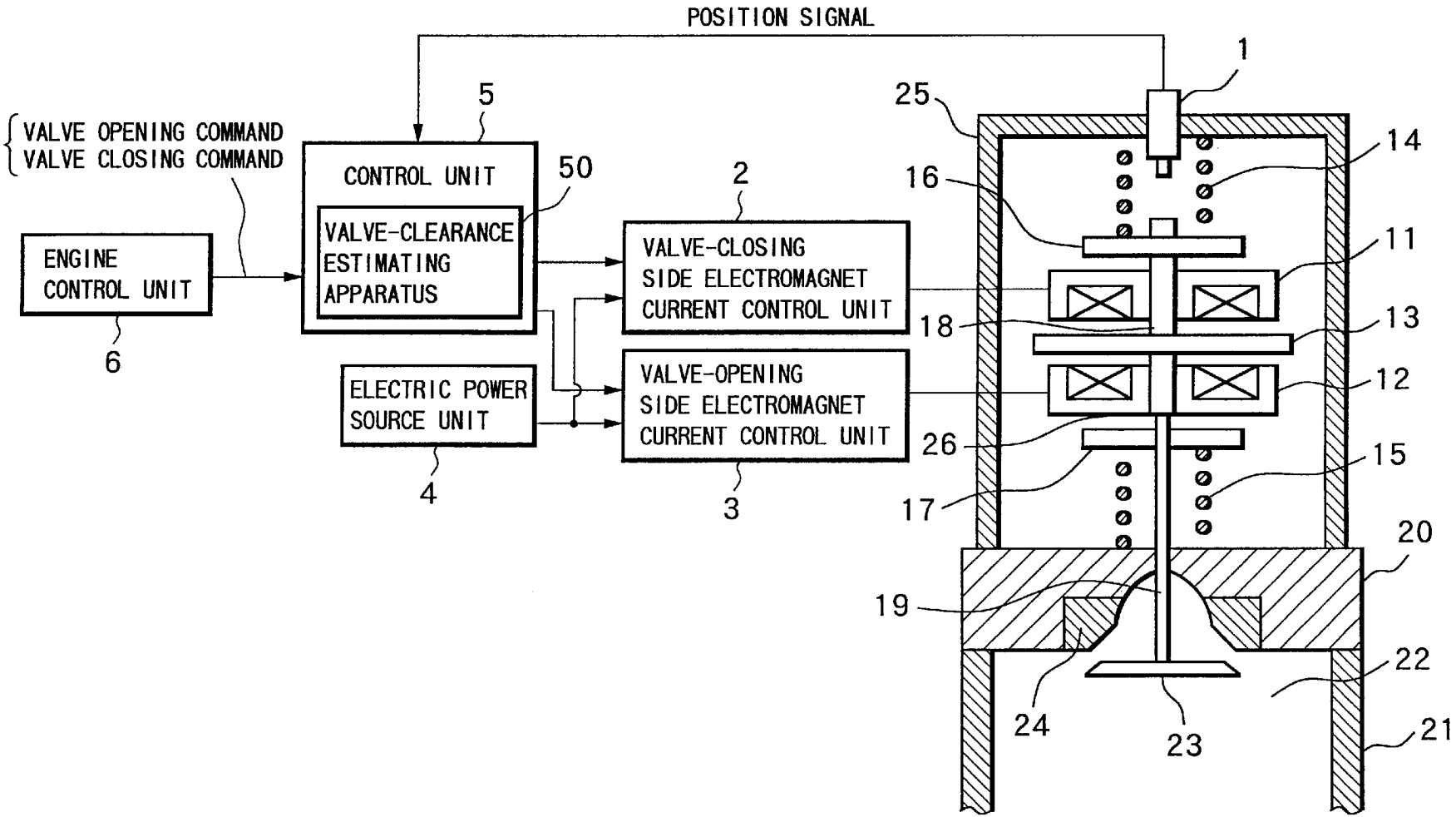
FIG. 1 is a diagrammatic view of an electro-magnetically operated valve to which the present invention is applied, illustrating an entire arrangement of the valve.

FIG. 1 illustrates an overall arrangement of a valve-clearance estimating apparatus for an electro-magnetically operated valve according to an embodiment of the present invention, applied to an internal combustion engine. A cylinder head 20 secured to an upper portion of one of cylinders 21 defining a chamber 22 of an internal combustion engine is provided with an electro-magnetically operated valve having a plurality of valve elements 23 (only one of them is shown here), which function as an intake valve and an exhaust valve of the internal combustion engine. The valve element 23 is provided with a valve stem 19 extending upward and having a retainer 17 fixed to an upper portion thereof. A spring 15, i.e., an elastic element is arranged between the retainer 17 and the cylinder head 20 to elastically urge the valve element 23 toward its closing position. A housing 25 is mounted on the top of the cylinder head 20 to form a casing for the electro-magnetic valve. The housing 25 houses therein an upper valve-closing side electro-magnet 11 and a lower valve-opening side electro-magnet 12 which are fixed so as to axially confront one another vertically via a predetermined axial spacing therebetween. A vertically movable valve drive element 13 is provided with an axially extending vertical shaft 18, and is arranged to be vertically moved between the valve-closing and opening side electro-magnets 11 and 12 in a slidable manner with the help of the vertical shaft 18. The vertical shaft 18 of the movable drive element 13 extends upward beyond the upper valve-closing side magnet 11, and is provided with a retainer 16 fixed to the uppermost portion of the vertical shaft 18. A spring 14 is arranged between the retainer 16 and an inner face of the ceiling of the housing 25 so as to constantly urge the movable drive element 13 toward a valve opening position, i.e., a position where the valve element 23 is moved down and away from a valve seat 24.

It should be noted that the valve drive element 13 and the valve element 23 form an essential part of a moving body and are provided as different elements, which are preferably made separately, and a valve clearance 26 is provided between the vertical shaft 18 of the valve drive element 13 and the valve stem 19 of the valve element 23. Namely, during the operation of the electro-magnetically operated valve, the valve element 23 will be thermally expanded by heat transmitting from the internal combustion engine, and the valve seat 24 will be unable to avoid mechanical abrasion due to repeated contact thereof with the valve element 23. The provision of the above-mentioned valve clearance compensates for the thermal expansion of the valve element 23 and the abrasion of the valve seat 24 and accordingly, the electro-magnetically operated valve can be prevented from failure in closing.

It should be understood that an axial spacing appearing between the end of the vertical shaft 18 of the valve drive element 13 and the end of the valve stem 19 of the valve element 23 when the valve element 23 is in contact with the valve seat 24 and when the valve drive element 13 is moved to a valve closing position thereof while in contact with the lower face of the valve-closing side electro-magnet 11 will be hereinafter defined as the length of the valve clearance.

Further, the ceiling of the housing 25 supports thereon a position sensor 1 for the moving body that moves together with the valve drive element. The position sensor 1 for the moving body is formed by, e.g., a laser range finder, and is arranged for detecting a positional change of the moving body with respect to a given reference position so that instant positions of the moving body may be detected during the movement of the moving body. The position sensor 1 transmits an output signal indicating the detected position of the moving body integrally moving with the valve drive element 13. The output signal is transmitted to a control unit 5, which forms a controller for the electro-magnetically operated valve.

The control unit 5 includes, as a part thereof, a valve-clearance estimating apparatus 50 which emits an output signal indicating an estimated value of the valve-clearance to be used for controlling the operation of the electro-magnetically operated valve. The control unit 5 is operatively connected to an engine control unit 6 to receive a command signal indicating either a valve opening or a valve closing. Upon receipt of the command signal, the control unit 5 emits an output indicating a desired value of electric current toward an electro-magnet current control unit 2 for valve closing and an electromagnet current control unit 3 for valve opening, respectively. The control unit 5 per se may be implemented by a microprocessor.

The electromagnet current control units 2 and 3 for valve closing and valve opening are electrically connected to the valve-closing side electromagnet 11 and the valve-opening side electromagnet 12, respectively, so that electric excitation currents which are modulated based on the desired values of the electric current by the pulse-width modulated control (PWM control) are supplied to the electromagnets 11 and 12 from an electric power source unit 4 to thereby adjustably control the operation of the valve-closing side or valve-opening side electromagnet 11 or 12.

Figure 2:
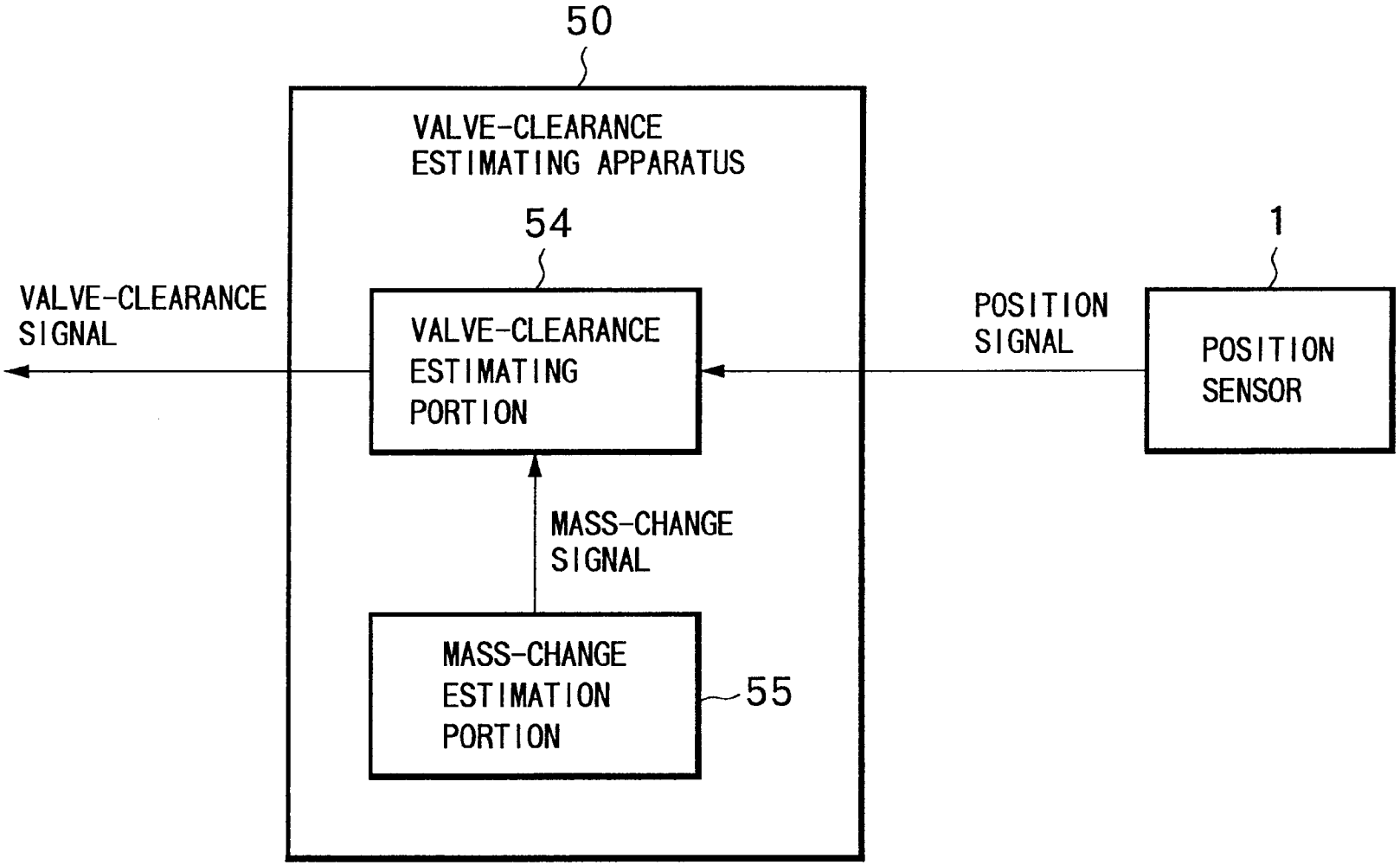
FIG. 2 is a schematic block diagram, illustrating an embodiment of a valve-clearance estimating apparatus according to the present invention.

FIG. 2 shows a preferred embodiment of the above-mentioned valve-clearance estimating apparatus 50. In FIG. 2, the valve-clearance estimating apparatus 50 includes a mass-change estimating portion 55, which estimates a change in an amount of mass of a moving body that moves together with the valve drive element 13, and a valve-clearance estimating portion 54, which estimates an amount of the valve-clearance on the basis of the positional change signal detected by the position sensor 1 for the moving body and the change in the mass amount estimated by the mass-change estimating portion 55. It should be understood that the position sensor 1 for the moving body in FIG. 2 referred to that shown in FIG. 1.

Figure 3:
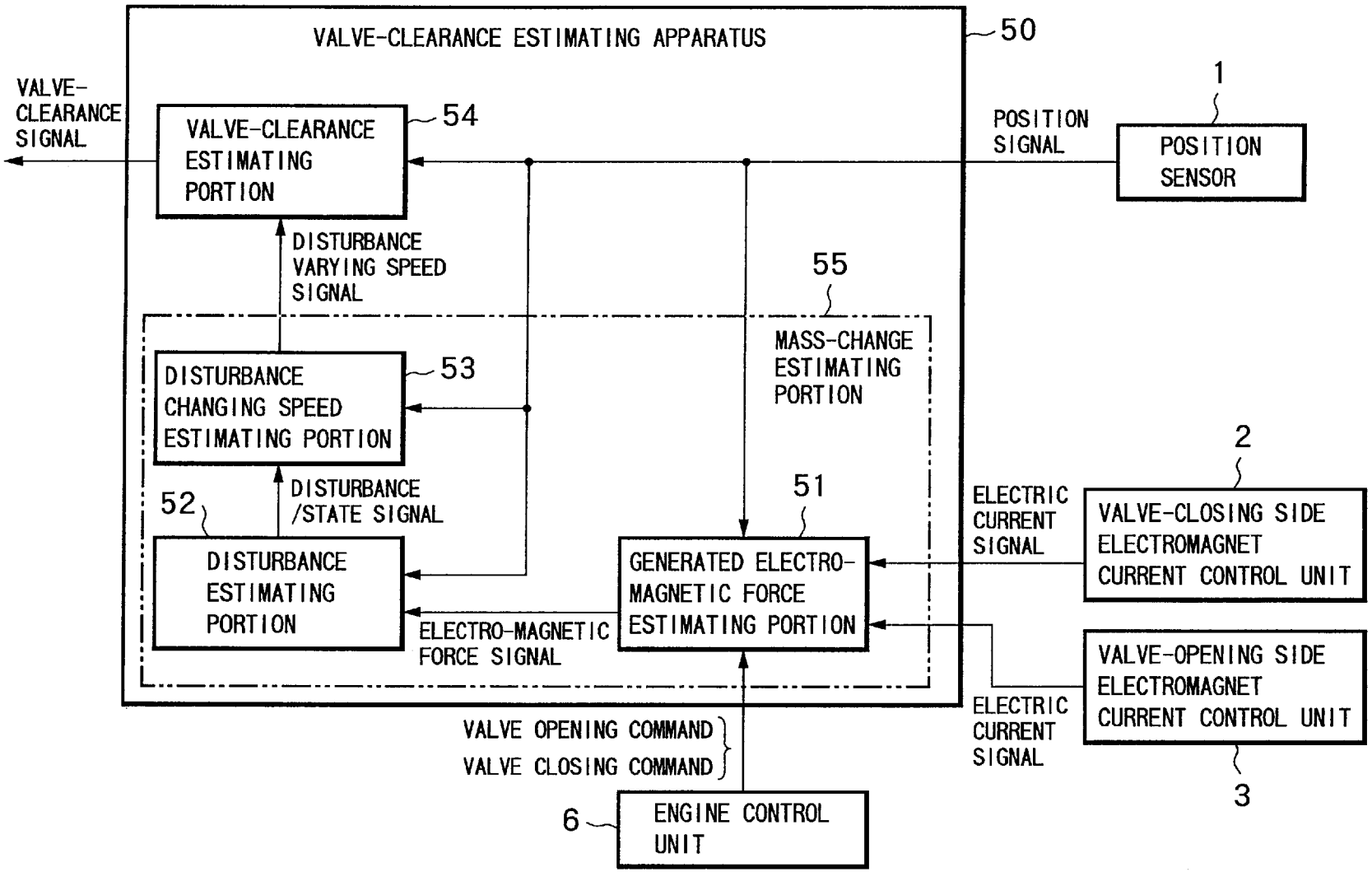
FIG. 3 is a block diagram illustrating a detailed arrangement of an embodiment of the valve-clearance estimating apparatus according to the present invention.

FIG. 3 illustrates a an embodiment of the valve-clearance estimating apparatus 50. The apparatus 50 includes a generated electro-magnetic force estimating portion 51, which estimates an electro-magnetic force generated by the electromagnet 11 or 12 on the basis of the position signal supplied by the position sensor 1 for the moving body, the current signal supplied by the electro-magnet current control unit 2 for valve closing or the electro-magnet current control unit 3 for valve opening, and the valve opening or closing command supplied by the engine control unit 6. The generated electro-magnetic force estimating portion 51 outputs a signal indicating electro-magnetic force on the basis of the estimation.

The valve-clearance estimating apparatus 50 further includes a disturbance estimating portion 52, which estimates a disturbance acting on the moving body on the basis of the position signal supplied by the position sensor 1 for the moving body and the electro-magnetic force signal supplied by the generated electro-magnetic force estimating portion 51. The disturbance estimating portion 52 generates an output signal indicating a disturbance acting on the moving body as well as a state of the moving body. The valve-clearance estimating apparatus 50 further includes a disturbance varying speed estimating portion 53, which estimates varying speed of the disturbance on the basis of the disturbance/state signal supplied by the disturbance estimating portion 52 and the position signal supplied by the position sensor 1 for the moving body. The estimated value of the disturbance varying speed is outputted by the disturbance varying speed estimating portion 53 as a disturbance varying speed signal. The valve-clearance estimating portion 54 of the valve-clearance estimating apparatus 50 estimates a valve-clearance on the basis of the disturbance varying speed signal supplied by the disturbance varying speed estimating portion 53 and the position signal supplied by the position sensor 1 for the moving body. It should be understood that the generated electro-magnetic force estimating portion 51, disturbance estimating portion 52, and the disturbance varying speed estimating portion 53 implement the mass-change estimating portion 55 described with reference to FIG. 2, which estimates a mass change of the moving body on the basis of a value (a disturbance) obtained by subtracting the known force components such as an electro-magnetic force of the electromagnets 11 and 12, an elastic force of the springs 14 and 15, and frictional and viscous forces acting on the moving body from an estimated force acting on the moving body. The position sensor 1 for the moving body, the valve-closing side electromagnet current control unit 2, and the valve-opening side electromagnet current control unit 3, and the engine control unit 6 are the same as those described with reference to FIG. 1.

The description of the operation of the electro-magnetically operated valve and the control unit 50 will be provided hereinbelow.

In FIG. 1, the valve drive element 13 is suspended by the upper and lower identical springs 14 and 15, and the dimension of the two springs are designed so that the valve drive element 13 is located at an approximately middle position between the valve-closing and opening side electromagnets 11 and 12 when the latter are not electrically excited. Further, the spring coefficient of the two springs 14 and 15 are selected such that the electro-magnetically operated valve can be opened or closed in a predetermined time.

It is known that a natural frequency $f_0$ of a spring-mass system consisting of the two springs 14, 15, and the moving body including the valve element 23 and the valve drive element 13 can be defined by the equation below, i.e., $$f_0=\sqrt{(k/m)}$$

where k is a composite spring coefficient and m is a total inertial mass.

In an initial operation prior to the starting of the internal combustion engine, if the valve-closing side electromagnet 11 and the valve-opening side electromagnet 12 are alternatively supplied with an electric excitation current at a frequency corresponding to the above-mentioned natural frequency $f_0$, the moving body comes into a resonant vibration and the width of the vibration of the moving body is gradually increased. Thus, at the end stage of the initial operation, the valve drive element 13 is magnetically attracted to one of the two electromagnets 11 and 12, e.g., the valve-opening side electromagnet 12, and the attracted condition will be maintained.

Then, either at the moment of the start of the engine or during the normal operation of the engine, for example, when the valve element 23 is closed, the supply of the electric excitation current to the valve-opening side electromagnet 12 is stopped to disable the magnetic attractive force of the electromagnet 12, and accordingly the moving body will be moved up by the spring force of the spring 15. However, only the spring force of the spring 15 cannot move the valve drive element 13 to a position that completely closed the electro-magnetically operated valve, due to an energy loss caused by, e.g., a kinetic friction generated in the moving body during the movement thereof. Therefore, when the valve drive element 13 approaches the valve-closing side electromagnet 11, until it arrives at a position effective for being electro-magnetically attracted by the electromagnet 11, the latter is supplied with the electric excitation current so as to assist the approaching movement of the valve drive element 13. Nevertheless, at this stage, immediately before the valve drive element 13 comes into contact with the electromagnet 11, it is necessary to prevent not only the valve drive element 13 from colliding against the electromagnet 11 but also the valve element 23 from strongly coming into contact with the valve seat 24. Namely, shock applied to the valve drive element 13 and to the valve element and seat 23 and 24 must be minimized. To this end, the movement of the valve drive element 13 needs to be delicately controlled while taking into consideration that position at every instant of the valve element 23 with respect to a given reference position, e.g., a predetermined position in connection with the position sensor 1. Thus, if the valve-clearance defined between the valve drive element 13 and the valve element 23 is acquired, an instant position of the valve element 23 can be detected from a detected position of the valve drive element 13, and accordingly the valve element 23 can be seated on the valve seat 24 with an appreciably reduced contact shock. Further, it is possible to provide a predetermined small gap between the valve drive element 13 and the electromagnet 11 when the valve element 23 arrives at its complete closed position, and as a result, colliding of the valve drive element 13 with the electromagnet 11 can be avoided to suppress noise due to the collision.

The description of the operation of the valve-clearance estimating apparatus will now be provided below.

Figure 4:
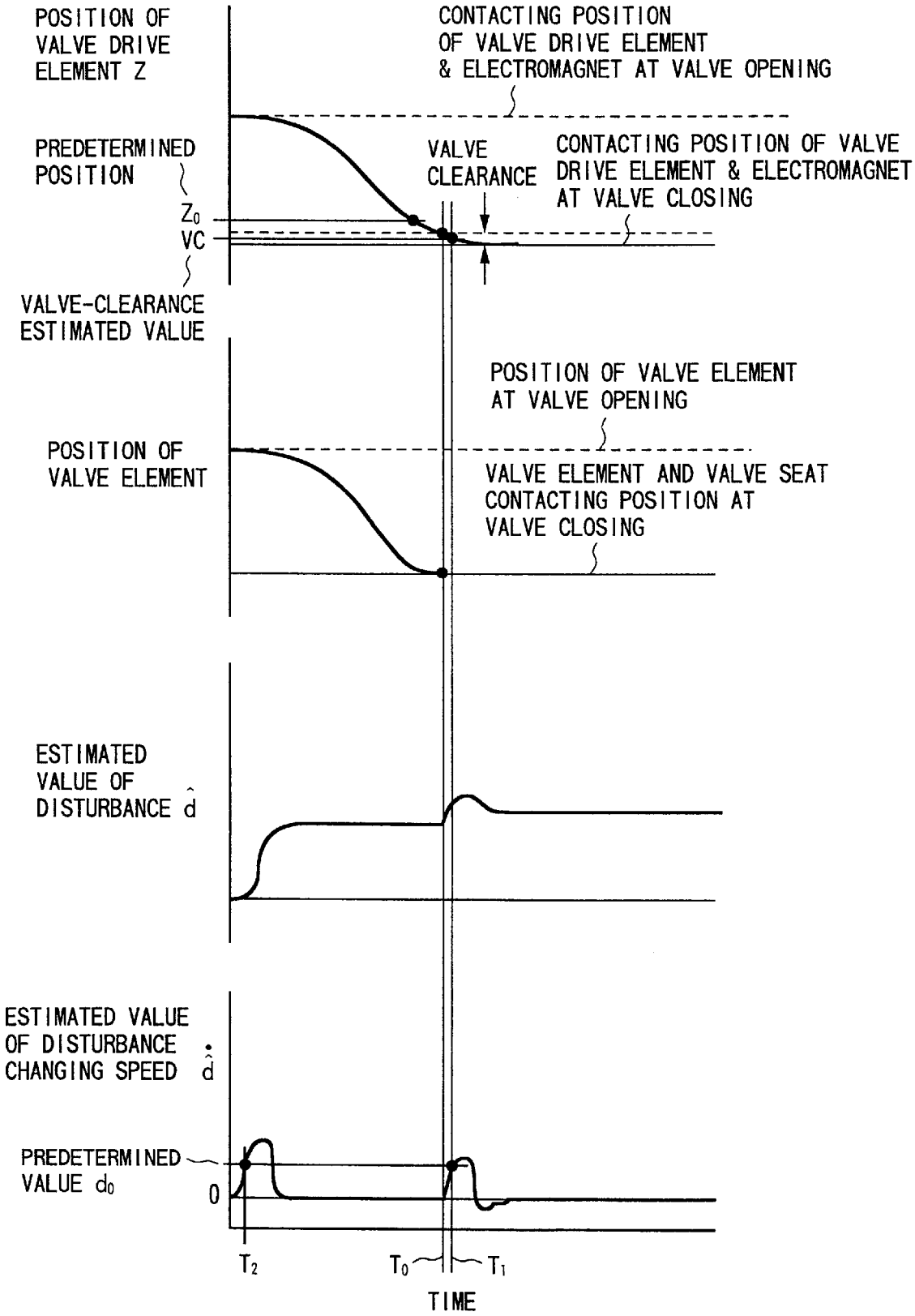
FIG. 4 is a graphical view illustrating an operation for estimating a valve-clearance of the electro-magnetically operated valve according to an embodiment of the present invention.

Four time charts in FIG. 4 (read top to bottom) indicate the change in the position z of the valve drive element 13 between a contacting position with the valve-opening side electromagnet 12 and a contacting position with the valve-closing side electromagnet 11, the change in the position of the valve element 23 between the opening and closing positions thereof, the estimated value of the disturbance, and the estimated value of the disturbance varying speed with regard to the time, respectively, in order to make it easier to understand the operation of the valve-clearance estimating apparatus.

When the valve drive element 13 is in contact with the valve-opening side electromagnet 12, i.e., when the valve element 13 of the electro-magnetically operated valve is in its opening position, the valve 23 and valve drive element 13 are together. When the valve element 13 is moved to its closing position, the valve 23 and valve drive element 13 are moved together. However, when the valve element 23 reaches the closing position at a time designated by To, the valve drive element 13 is further moved while separating from the valve element 23. Thus, as soon as the valve element 23 reaches the closing position thereof, the moving body does not include therein the valve element 23, and accordingly the mass of the moving body no longer includes the mass of the valve element 23. That is, the mass of the moving body occasionally changes, and thus the mass of the moving body during actually moving thereof is differentiated from the mass of the moving body known at the time of designing a disturbance-estimating observer. Accordingly, an estimated value $\hat{d}$ of the disturbance must change. A change in the estimated value $\hat{d}$ of the disturbance can be read from an estimated value $\hat{d}$ of the disturbance changing speed. Thus, when the estimated value $\hat{d}$ of the disturbance changing speed reaches a predetermined value at the time $T_1$, the position of the valve drive element 13 is used as an estimated value VC of the valve-clearance.

On the other hand, when the valve drive element 13 begins to be moved away from its contacting valve-opening side electromagnet 12, the estimated value $\hat{d}$ of disturbance may change due to the effect of eddy current occurring in and left in the valve drive element 13. Therefore, the estimated value $\hat{d}$ of the disturbance changing speed might become equal to or larger than a predetermined value d0 (at the time $T_2$ in the chart of FIG. 4). Thus, it might occur that the valve-clearance is erroneously estimated. Therefore, only when the valve drive element 13 is moved to any position within a predetermined positional range $Z_0$ with reference to the contact position of the element 13 and the valve-closing side electromagnet 11 (the predetermined positional range $Z_0$ of the valve drive element should be understood as a preliminarily determined range of the position at which the valve drive element 13 is approximately close to the valve-closing side electromagnet 11), is the estimated value $\hat{d}$ of the disturbance changing speed becoming the predetermined value d0, is understood as the estimated value VC of the valve clearance.

Now, the description of the operations of the generated electro-magnetic force estimating portion 51, the disturbance estimating portion 52, the disturbance varying speed estimating portion 53, and the valve-clearance estimating portion 54 of the valve-clearance apparatus 50, which are shown in FIG. 3 will be provided hereinbelow with reference to FIGS. 5 through 7.

Figure 7:
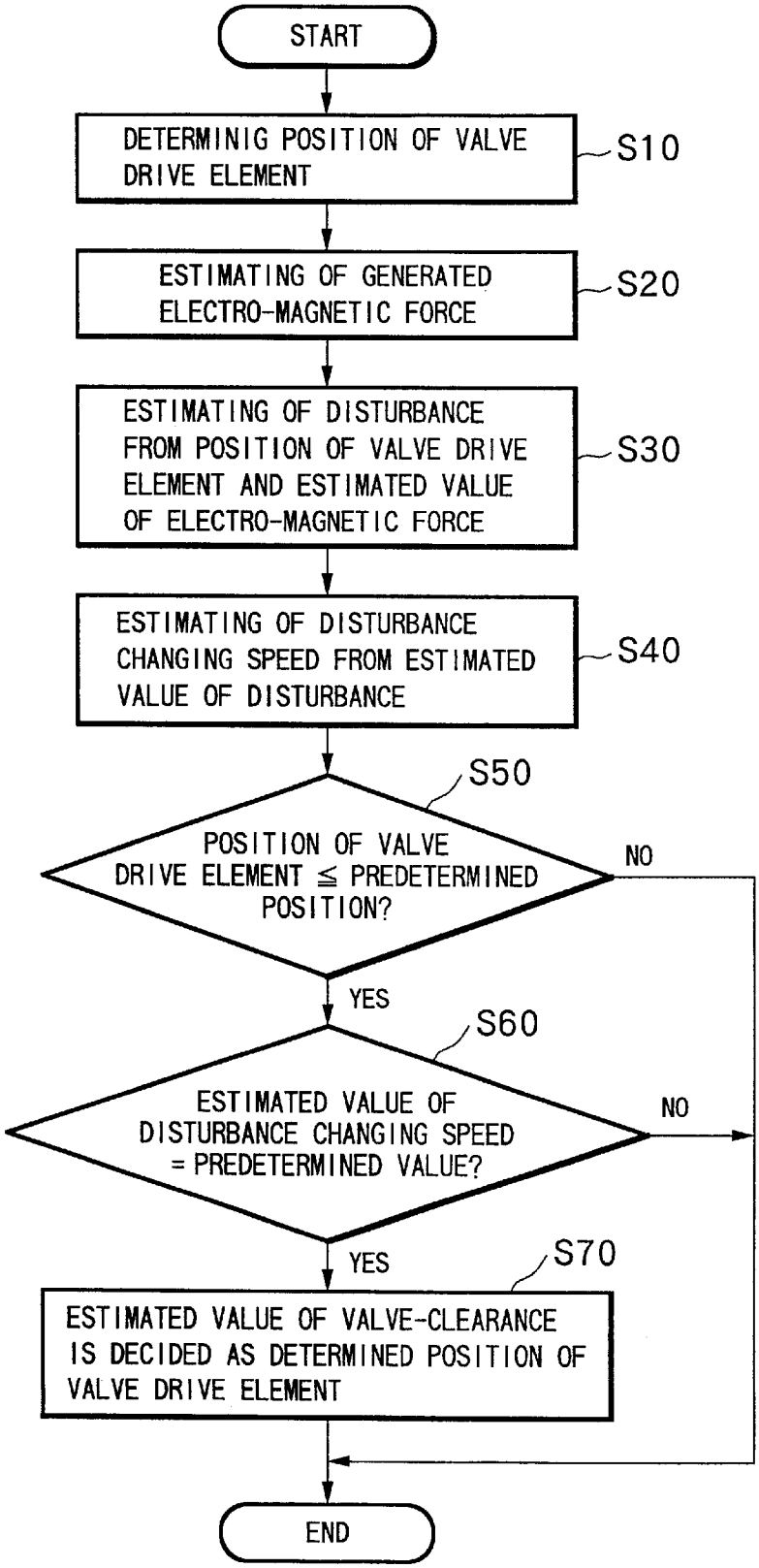
FIG. 7 is a flow chart illustrating an entire operation of the embodiment of the present invention.

The operation performed by the generated electro-magnetic force estimating portion 51 appears in step S20 of the flow chart of FIG. 7. That is, after the detecting or determining of the position of the valve drive element 23 by the position sensor 1 (Step S10 of FIG. 7), estimation of the electro-magnetic magnetic force generated by the electro magnet 11 or 12 is performed by the generated electro-magnetic force estimating portion 51 in step S20.

Figure 5:
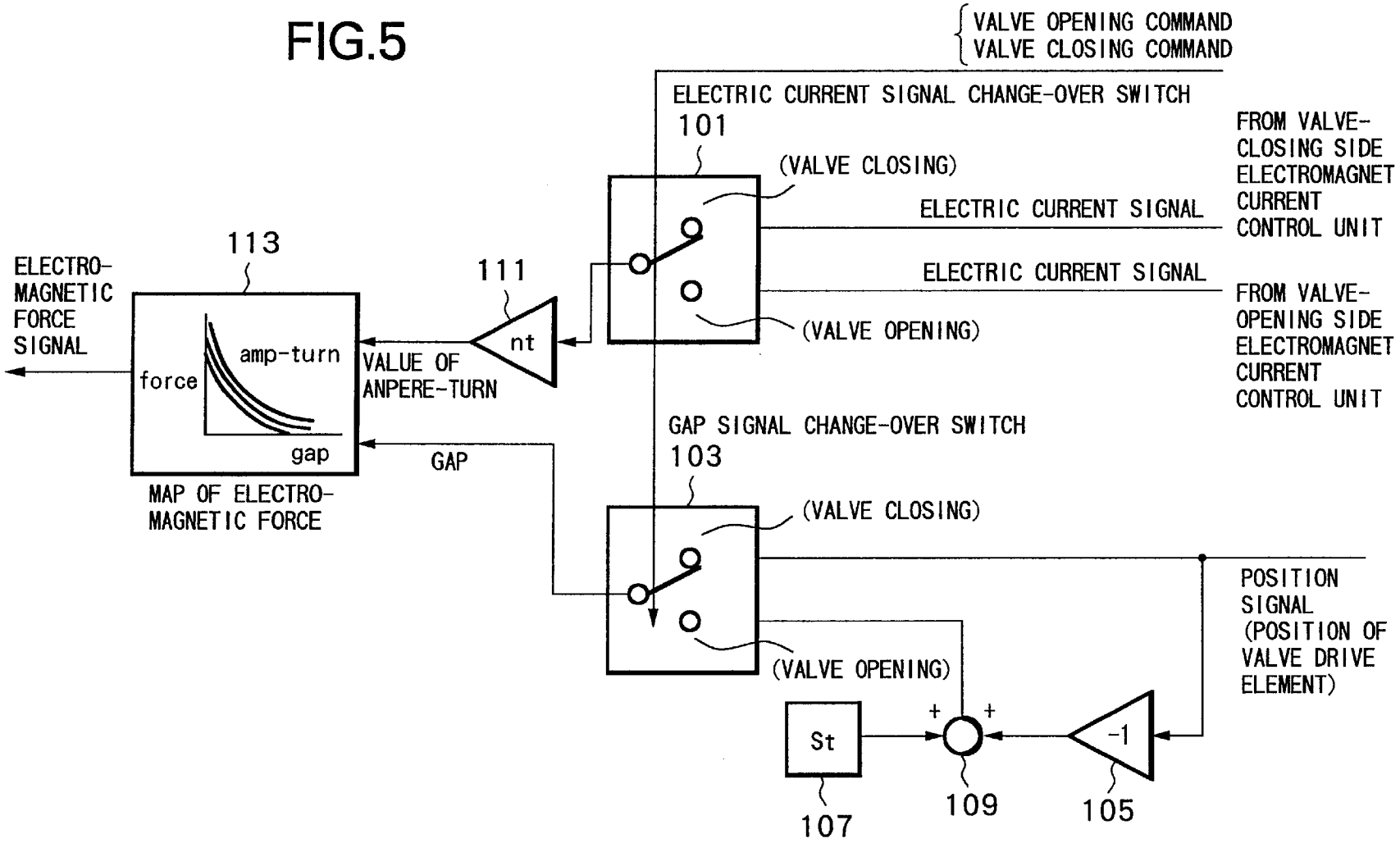
FIG. 5 is a block diagram illustrating an arrangement of a functional portion for estimating a generated electro-magnetic force, according to an embodiment of the present invention.

As shown in FIG. 5, the generated electro-magnetic force estimating portion 51 receives the signal of position of the valve drive element 13 emitted by the position sensor 1 for the moving body, the signal of electric current emitted by the valve-opening or valve-closing side electromagnet current control unit 2 or 3, the valve-opening command or valve-closing command emitted by the engine control unit 6 at the input thereof, and emits an output signal indicating an estimated value of electro-magnetic force. Thus, the generated electro-magnetic force estimating portion 51 is provided with a current signal changing switch 101, which operates to switch the current signal supplied by the valve-closing side electro-magnet current control unit 2 to that supplied by the valve-opening side electro-magnet current control unit 3 and vice versa, in response to the command signal indicating the valve-closing or opening. The generated electro-magnetic force estimating portion 51 further includes a gap-signal changing switch 103 operating so as to switch a gap-signal in response to the command signal indicating the valve-closing or opening, a multiplier 111 operating so as to multiply the current signal with the number of turn "nt" of the coils of the electromagnet 11 or 12, and an electro-magnetic force map 113. The multiplier 111 emits an output signal indicating the value of the ampere-turn obtained by the multiplying operation toward the electro-magnetic force map 113.

The electro-magnetic force map 113 emits an output signal indicating an electro-magnetic force, an extent of which depends on the value of ampere-turn (the electric current×the number of turn "nt" of the electro-magnet coil) and an amount of gap between the valve drive element 13 and any excited one of the electro-magnets 11 and 12.

It should be understood that the electro-magnetic force map 113 is a map determined by the shapes and the properties of the electromagnets 11, 12 and the valve drive element 13, and is produced by actual measurement of the electro-magnetic force acting between these electromagnets 11, 12 and the valve drive element 13. The electro-magnetic force map 113 may alternatively be produced by another suitable means for analyzing the magnetic field of an electromagnet.

The coordinate of position of the valve drive element 13 is determined under a condition such that a position at which the valve drive element 13 comes in contact with the valve-closing side electromagnet 11 corresponds to the origin of the coordinate, and a direction of change in the position of the valve drive element 13 toward the valve-opening side electromagnet 12 is a positive direction. Thus, a gap between the valve drive element 13 and the excited electromagnet 11 or 12 is determined as follows. That is, when the electro-magnetically operated valve is opened, the gap corresponds to a value ($S_1$−z) that is obtained by subtracting the position signal z from a total stroke $S_1$ of the valve drive element 13 between valve-opening side electromagnet 12 to the valve-closing side electromagnet 11. When the electro-magnetically operated valve is closed, the gap corresponds to a value (z), which is the same as the amount of the position signal "z". Thus, the above-mentioned gap changing switch 103 switches the gap signals from one to the other and vice versa.

Multiplying the value of electric current and the number of turns "nt" of the coil can obtain the value of ampere-turn, and for the value of electric current, the electric current signal supplied by the valve-opening side electromagnet current control unit 3 is used at the time of opening the electro-magnetically operated valve, and the electric current signal supplied by the valve-closing side electromagnet current control unit 2 is used at the time of closing the electro-magnetically operated valve. The determination of the opening and closing of the electro-magnetically operated valve is conducted by the valve-opening command and the valve-closing command generated by the engine control unit 6.

The operation performed by the disturbance estimating portion 52 corresponds to step S30 in the flow chart of FIG. 7. Namely, in step S30, estimation of the value of the disturbance is conducted on the basis of the position of the valve drive element 13 arriving at that moment and the estimated value of the electro-magnetic force acting at that moment. Namely, the disturbance estimating portion 52 estimates a disturbance acting on the moving body including the valve drive element 13 and the valve element 23 on the basis of the estimated value of the electro-magnetic force outputted by the generated electro-magnetic force estimating portion 51. The disturbance estimating portion 52 may be implemented by a disturbance estimating observer. An equation of motion of the moving body including the valve drive element 13 and valve element 23 is represented by an equation (1), shown below.

$$m\ddot{z}+c\dot{z}+kz=f+d \tag{1}$$

where "z" indicates the position of the valve drive element 13 under a condition such that a position at which the valve drive element 13 comes in contact with the valve-closing side electromagnet 11 is the origin, and a direction of the change in the position of the same element 13 toward the valve-valve-opening side electromagnet 12 is positive. Further, in the above equation (1), "m" is the total inertial mass of the moving body including the valve drive element 13 and the valve element 23, "k" is a composite spring coefficient, "c" is a coefficient of viscosity, "d" is a disturbance, and "f" is an electro-electro-magnetic force for which an estimated value of electro-magnetic force is used.

When the equation of motion (1) is converted to a state equation, the following three equations (2), (3) and (4) are obtained.

$$\dot{z}_p = A_p z_p + B_p(f + d) \tag{2}$$

$$y = C_p z_p \tag{3}$$

$$A_p = \begin{bmatrix} 0 & 1 \\ -\frac{k}{m} & -\frac{c}{m} \end{bmatrix},$$

$$B_p = \begin{bmatrix} 0 \\ \frac{1}{m} \end{bmatrix},$$

$$C_p = [1, 0], \tag{4}$$

$$z_p = \begin{bmatrix} z \\ \dot{z} \end{bmatrix}$$

In the above state equations (2) through (4), "zp" indicates the state of a controlled system. Further, "y" indicates an output of the controlled system, i.e., a position of the valve drive element 13 determined by the position sensor 1.

When a disturbance "d" is assumed to be constant, $\dot{d}$ equals to 0 ($\dot{d}$=0).

Now, if an extended system of the equations (2) and (3) is formed, the equations (5) through (7) below, are obtained.

$$\dot{z}_a = A_a z_a + B_a f \tag{5}$$

$$y = C_a z_a \tag{6}$$

$$A_a = \begin{bmatrix} 0 & 0 \\ B_p & A_p \end{bmatrix},$$

$$B_a = \begin{bmatrix} 0 \\ B_p \end{bmatrix},$$

$$C_a = [0 \quad C_p] \tag{7}$$

$$z_a = \begin{bmatrix} d \\ z_p \end{bmatrix}$$

Figure 6:
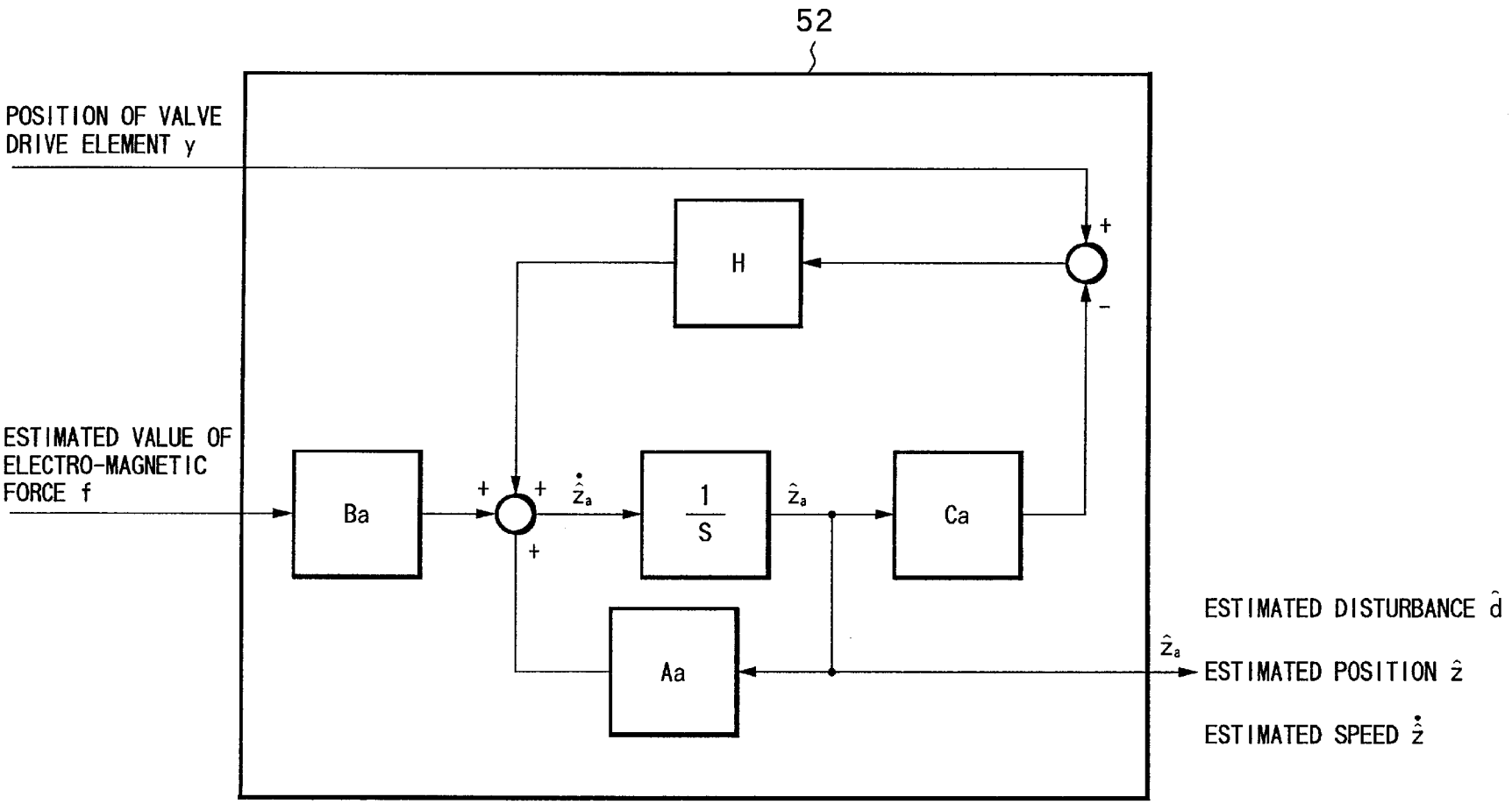
FIG. 6 is a block diagram illustrating an arrangement for a functional portion for estimating a disturbance, according to an embodiment of the present invention.

The disturbance estimating observer, which may implemented as the disturbance estimating portion 52 is shown in FIG. 6. It will be understood from the block diagram of FIG. 6 that the disturbance estimating observer implements an equation (8), below.

$$\dot{\hat{z}}_a = (A_a - HC_a)\cdot\hat{z}_a + B_a f + Hy \tag{8}$$

where H=[h1 h2 h3]$^T$ is a gain of the observer for stabilizing the item $A_a - HC_a$. $\hat{z}_a = [\hat{d} \quad \hat{z} \quad \hat{\dot{z}}]^T$, and $\hat{d}$, $\hat{z}$, and $\hat{\dot{z}}$ are a disturbance, and estimated values of the position and speed respectively.

The operation conducted by the disturbance varying speed estimating portion 53 corresponds to step S40 of the flow chart of FIG. 7. Namely, in step S40 of the flow chart, a disturbance changing speed is estimated from the estimated value of the disturbance.

More specifically, the operation of the disturbance varying speed estimating portion 53 estimates a changing speed of the estimated value of the disturbance by using an equation (9) below, from the position "y" outputted by the position sensor 1 for the moving body, and an estimated position $\hat{z}$ of the valve drive element 13, outputted by the position sensor 1 for the moving body.

$$\dot{\hat{d}} = h_1(y - \hat{z}) \tag{9}$$

where $\dot{\hat{d}}$ is an estimated value of the disturbance changing speed.

The operation of the valve-clearance estimating portion 54 will be described hereinbelow with reference to the flow chart of FIG. 7.

In the flow chart of FIG. 7, the operation of the valve-clearance estimating portion 54 starts from Step S50. Thus, the valve-clearance portion 54 initially determine whether or not an instant position of the valve drive element 13 has reached within the predetermined positional range $Z_0$, i.e., whether or not the position of the valve drive element 13 comes close to the valve-closing side electromagnet 11, in Step S50. When it is determined that the instant position of the valve drive element 13 reaches within the predetermined positional range $Z_0$ (YES), an operation to determine whether or not the disturbance varying speed estimated value $\dot{\hat{d}}$ is a predetermined value $d_0$ (see FIG. 4), is carried out in Step S60. When it is determined that the disturbance varying speed estimated value $\dot{\hat{d}}$ is the predetermined value $d_0$ (YES), the estimated value of the valve-clearance is decided as a detected or determined value of the valve drive element 13 in Step S70. In Step S50 or S60, if NO is determined, the operation goes to the end as shown in FIG. 7.

It will be understood from the foregoing that the valve-clearance estimating portion 54 estimates the value of the valve-clearance from the position of the valve drive element 13 when the disturbance changing speed estimated value $\dot{\hat{d}}$ supplied by the disturbance varying speed estimating portion 53 is determined to be the predetermined value $d_0$.

In accordance with the described embodiment of the electro-magnetically operated valve of which the movement is driven by the combination of a spring force and an electro-magnetic force may be used as intake and exhaust valves of an internal combustion engine, any disturbance acting on the moving body including the valve drive element 13 and the valve element 23 is estimated by the disturbance estimating observer on the basis of the data of position of the valve drive element 13 and the data of electro-magnetic force generated by the electromagnet 11 or 12, and the valve-clearance is estimated on the basis of a variation in the above-mentioned estimated value of the disturbance. Thus, several advantages can be obtained as described below.

As soon as the valve element 23 is seated on the valve seat 24 during the movement of the moving body, the valve element 23 and the valve drive element 13 are separated away from one another. Therefore, the mass of the moving body is reduced by an amount corresponding to the mass of the valve element 23. Initially, the disturbance estimating observer (the disturbance estimating portion 52) is set under a condition such that the mass of the moving body corresponds to a value including both the mass of the valve drive element 13 and the valve element 23. Nevertheless, during the opening and closing operation of the electro-magnetically operated valve, the actual mass of the moving body is not the same as the initially set mass thereof. Accordingly, the estimated value of the disturbance varies, and from such variation in the estimated value of the disturbance it is possible to determine whether or not the valve element 23 is seated on the valve seat 24. Thus, the value of the valve-clearance between the valve drive element 13 and the valve element 23 at the moment of seating of the valve element 23 on the valve seat 24 can be estimated.

Any variation in the estimated value of the disturbance can be easily detected from the speed component thereof, and therefore the value of the valve clearance can be accurately determined and estimated.

When the valve drive element 13 starts to move away from one of the valve-closing and valve opening side electromagnets 11 and 12, the estimated value of the disturbance might vary under influence of residual eddy current left in the valve drive element 13. In the present invention, it is indispensable to detect a variation in the estimated value of the disturbance at the moment that the valve element 23 is seated on the valve seat 24. In this connection, according to the above-described embodiment, a variation in the estimated value of the disturbance is comprehended when the valve drive element 13 is moved to a position approximately close to the valve-closing side electromagnet 11, and accordingly the influence of the eddy current left in the valve drive element 13 is considerably reduced, so that an erroneous estimation of the valve-clearance can be prevented.

The estimation of the value of the valve-clearance is conducted every time when the electro-magnetically operated valve closes, any change in the value of the valve-clearance due to the thermal expansion of the valve element 13 caused by heat transmitted from the engine, the abrasion of the valve seat 24, for example, does not cause an error in estimated of the value of the valve-clearance. Thus, it is ensured that the valve-clearance estimating apparatus 50 can constantly carry out an accurate estimation of the valve-clearance.

Determination of the valve-clearance through the accurate estimation thereof can be effective for optimum control of seating motion of the electro-magnetically operated valve on the valve seat 24. For example, when the valve is seated on the valve seat, i.e., when the valve element and the valve drive element are separated from one another, a controlling gain in controlling of the electric excitation current can be adjustably changed over to precisely control the speed and the time required for the valve drive element 13 to come in contact with the valve-close side electromagnet 11. Thus, a sufficient reduction in the contacting noise of the electro-magnetically operated valve as well as the electric power consumption for the electro-magnetically operated valve can be obtained.

The entire description of Japanese Patent Application No. 2000-246396 is incorporated herein by reference.

While only selected embodiments have been chosen to illustrate the present invention, it will be apparent to a person skilled in the art from this disclosure that various changes and modifications will occur herein without departing from the scope of the invention as defined in the accompanied claims. Furthermore, the foregoing description of the embodiments according to the present invention are provided for illustration only, and not for the purpose of limiting the invention as defined by the accompanied claims and their equivalents.

What is claimed is:

1. A valve-clearance estimating apparatus for estimating a valve-clearance that is a minute spacing produced between a valve drive element and a valve element, which when in contact form a moving body of an electro-magnetically operated valve provided with a pair of electromagnets arranged to be spaced apart from one another via the valve drive element and generating, upon being electrically excited, an electro-magnetic force acting on the valve drive element, and a pair of springs exhibiting a spring force also acting on the valve drive element, said electro-magnetic force and said spring force permitting said valve drive element to move thereby driving said valve element toward either one of valve-closing and valve-opening positions, wherein said moving body includes only said valve drive element when said valve element is not in contact with said valve drive element; and wherein said valve-clearance estimating apparatus is operatively connected to a position sensor arranged to determine an instant position of said valve drive element of said electro-magnetically operated valve during a movement of said valve drive element, said valve clearance estimating apparatus comprising:

a mass-change estimating portion arranged to estimate a change in a mass of said moving body; and a valve-clearance estimating portion arranged to estimate said valve-clearance on the basis of said position of said valve drive element determined by said position sensor in coordination with the estimate of the change in said mass of said moving body.

2. The apparatus as set forth in claim 1, wherein said mass-change estimating portion estimates a change in said mass of said moving body from a variation in an estimated value of a force acting on said moving body.

3. The apparatus as set forth in claim 1, wherein said mass-change estimating portion estimates a change in said mass of said moving body from a variation in a value obtained by subtracting a known component from an estimated value of a force acting on said moving body.

4. The apparatus as set forth in claim 3, wherein said known component used in arithmetic operation performed by said mass-change estimating portion is selected from one of an electro-magnetic force, an elastic force, a frictional force and a viscous force.

5. The apparatus as set forth in claim 1, wherein said mass-change estimating portion estimates a change in said mass of said moving body from a changing speed of an estimated value of a force acting on said moving body.

6. The apparatus as set forth in claim 1, wherein said mass-change estimating portion estimates a change in said mass of said moving body from a value of changing speed of a value obtained by subtracting a known component from an estimated value of a force acting on said moving body.

7. The apparatus as set forth in claim 6, wherein said known component used in arithmetic operation performed by said mass-change estimating portion is selected from one of an electro-magnetic force, an elastic force, a frictional force and a viscous force.

8. The apparatus as set forth in claim 1, wherein said valve-clearance estimating portion estimates said valve-clearance from said determined position of said valve drive element at a time of estimating said change in said mass of said moving body when said valve drive element approximately comes close to said one of said pair of electromagnets, which is excited for closing said electro-magnetically operated valve.

9. An apparatus for estimating a valve-clearance that is a minute spacing produced between a valve drive element and a valve element, which when in contact form a moving body of an electro-magnetically operated valve which further includes a pair of electromagnets arranged to be spaced apart from one another via the valve drive element and generating, upon being electrically excited, an electro-magnetic force acting on the valve drive element, and a pair of springs exhibiting a spring force also acting on said valve drive element, said electro-magnetic force and said spring force permitting said valve drive element to move thereby driving said valve element toward either one of valve-closing and valve-opening positions, wherein said moving body includes only said valve drive element when said valve element is not in contact with said valve drive element, said apparatus comprising:

a position sensing means for determining a position of said valve drive element during a movement of said valve drive element;

a mass-change estimating means for estimating a change in a mass of said moving body and a valve-clearance estimating means for estimating said valve-clearance on the basis of said position of said valve drive element determined by said position sensing means in coordination with the estimate of the change in said mass of said moving body is estimated.

10. A control apparatus for controlling the operation of an electro-magnetically operated valve comprising:

a valve drive element;

a valve element driven by said valve drive element;

a pair of electromagnets arranged to be spaced apart from one another via said valve drive element and generating, upon being electrically excited, an electro-magnetic force acting on said valve drive element; said valve drive element and said valve element when in contact form a moving body of said electro-magnetically operated valve, wherein said moving body includes only said valve drive element when said valve element is not in contact with said valve drive element; and a pair of springs exhibiting a spring force acting on said valve drive element, said electro-magnetic force and said spring force permitting said valve drive element to move thereby causing a movement of said valve element toward either one of valve-closing and valve-opening positions of said electro-magnetically operated valve;

said control apparatus comprising:

an apparatus for estimating a valve-clearance that is a minute spacing produced between said valve drive element and said valve element, said valve-clearance estimating apparatus comprising a position sensor for determining a position of said valve drive element during a movement of said valve drive element, a mass-change estimating portion that estimates a change in a mass of said moving body, and a valve-clearance estimating portion estimating said valve-clearance on the basis of said position of said valve drive element determined by said position sensor in coordination with the estimate of the change in said mass of said moving body is estimated; and a control-switch arranged to switch a control gain in controlling the operation of said electro-magnetically operated valve in response to a position of said valve drive element determined by said position sensor of said valve-clearance estimating apparatus and a valve-clearance estimated by said valve-clearance estimating apparatus.

11. A method of controlling the operation of an electro-magnetically operated valve which is provided with: a valve drive element; a valve element driven by said valve drive element; a pair of electromagnets arranged to be spaced apart from one another via said valve drive element and generating, upon being electrically excited, an electro-magnetic force acting on said valve drive element, said valve drive element and said valve element when in contact form a moving body of said electro-magnetically operated valve, wherein said moving body includes only said valve drive element when said valve element is not in contact with said valve drive element; a pair of springs exhibiting a spring force acting on said valve drive element, said electro-magnetic force and said spring force permitting said valve drive element to move thereby causing a movement of said valve element toward either one of valve-closing and valve-opening positions of said electro-magnetically operated valve; and an apparatus for estimating a valve-clearance that is a minute spacing produced between said valve drive element and said valve element, said valve-clearance estimating apparatus comprising a position sensor determining an instant position of said valve drive element during a movement of said valve drive element, a mass-change estimating portion estimating a change in a mass of and said moving body, and a valve-clearance estimating portion estimating said valve-clearance on the basis of said position of said valve drive element determined by said position sensor at a time when said mass of said moving body is estimated, said method comprising:

switching a control gain in controlling the operation of said electro-magnetically operated valve in response to a position of said valve drive element determined by said position sensor of said valve-clearance estimating apparatus and a valve-clearance estimated by said valve-clearance estimating apparatus.

12. A method of estimating a valve clearance that is a minute spacing produced between a valve drive element and a valve element which when in contact form a moving body of an electro-magnetically operated valve which further includes a pair of electromagnets arranged to be spaced apart from one another via the valve drive element and generating, upon being electrically excited, an electro-magnetic force acting on the valve drive element, and a pair of springs exhibiting a spring force also acting on said valve drive element, said electro-magnetic force and said spring force permitting said valve drive element to move thereby driving said valve element toward either one of valve-closing and valve-opening positions, wherein said moving body includes only said valve drive element when said valve element is not in contact with said valve drive element, said method comprising:

sensing a position of said valve drive element during a movement of said valve drive element;

estimating a change in mass of said moving body; and estimating said valve clearance on the basis of said position of said valve drive element in coordination with the estimate of the change in mass of said moving body.

* * * * *